US008414340B1

(12) United States Patent
Vu

(10) Patent No.: US 8,414,340 B1
(45) Date of Patent: Apr. 9, 2013

(54) PERSONAL FLOTATION AND RESCUE DEVICE

(76) Inventor: Thang Vu, Crystal, MN (US)

( * ) Notice: Subject to any disclaimer, the term of this patent is extended or adjusted under 35 U.S.C. 154(b) by 215 days.

(21) Appl. No.: 12/986,204

(22) Filed: Jan. 7, 2011

(51) Int. Cl.
*B63H 9/00* (2006.01)
*B63B 35/58* (2006.01)
*B63B 3/00* (2006.01)

(52) U.S. Cl.
USPC ..... 440/8; 441/36; 441/80; 114/346

(58) Field of Classification Search ..... 441/35, 441/36, 80, 89; 114/345, 140, 346; 440/8
See application file for complete search history.

(56) References Cited

U.S. PATENT DOCUMENTS 3,595,190 A * 7/1971 Lapworth ..... 114/9
7,001,227 B1 2/2006 Vu

* cited by examiner

*Primary Examiner* — Stephen Avila
(74) *Attorney, Agent, or Firm* — Lawrence J. Gibney, Jr.

(57) ABSTRACT

The present invention is a device to be used in emergency situations requiring floatation and rescue. An inflatable raft with a waterproof cover is connected to a telescopic shaft equipped with electric generators and a wind harnessing mechanism. The electricity, which is produced by the wind harnessing mechanism powers a motor and propeller underneath and outside the raft.

4 Claims, 4 Drawing Sheets

PERSONAL FLOTATION AND RESCUE DEVICE

CROSS REFERENCES TO RELATED APPLICATIONS

This is a modification to the patent that was previously issued to the applicant titled Personal Floatation Device, U.S. Pat. No. 7,001,227.

BACKGROUND OF THE INVENTION

A. Field of the Invention

This relates to personal flotation rescue devices, particularly in the event of a mishap at sea. A person can enter a safe, confined space in the protective device. It is self contained and can be easily stowed when not in use.

B. Prior Art

This is an improvement over an existing patent issued to Vu, U.S. Pat. No. 7,001,227. The structure of the device has been substantially altered to further protect the individual although the operation of the device remains the same.

In the prior art, the individual was partially exposed because of openings on the shell of the device. In this improvement an individual will be completely protected against all elements because the individual is completely encased in the structure.

BRIEF SUMMARY OF THE INVENTION

This is a personal flotation device, which will completely encapsulate an individual in the event of a catastrophe on the water. The individual will be placed in the interior hollow section of the device and will be protected by a lower rigid shell. The device can be completely stored in a backpack for easy transport and stowage.

Additionally, a top shell will completely encase the individual but will be made of durable semi-rigid material that will fold over the lower portion of the device and completely protect the individual who is in the interior of the device.

Because some amount of propulsion is desired, a plurality of cups are located on the top of the structure to capture wind energy, which in turn is harnessed into energy for the propulsion system as well as power for a light on the top of the structure.

On the bottom of the structure a keel will be provided to provide some degree of stability for the device.

The device should be made of strong, durable material that can withstand extremes in temperature, wind and other environmental conditions.

NUMBERING REFERENCES

5—Device or Raft
10—Lower Half of Shell
15—Keel
20—Upper Half of Shell

21—Arms
22—Generators
23—Cups
24—Light
25—Wind Harnessing Mechanism
30—Support Members
35—Telescoping Shaft
40—Propeller
45—Electric Motor and Battery Assembly
50—Storage Means

DETAILED DESCRIPTION OF THE EMBODIMENTS

Figure 1:
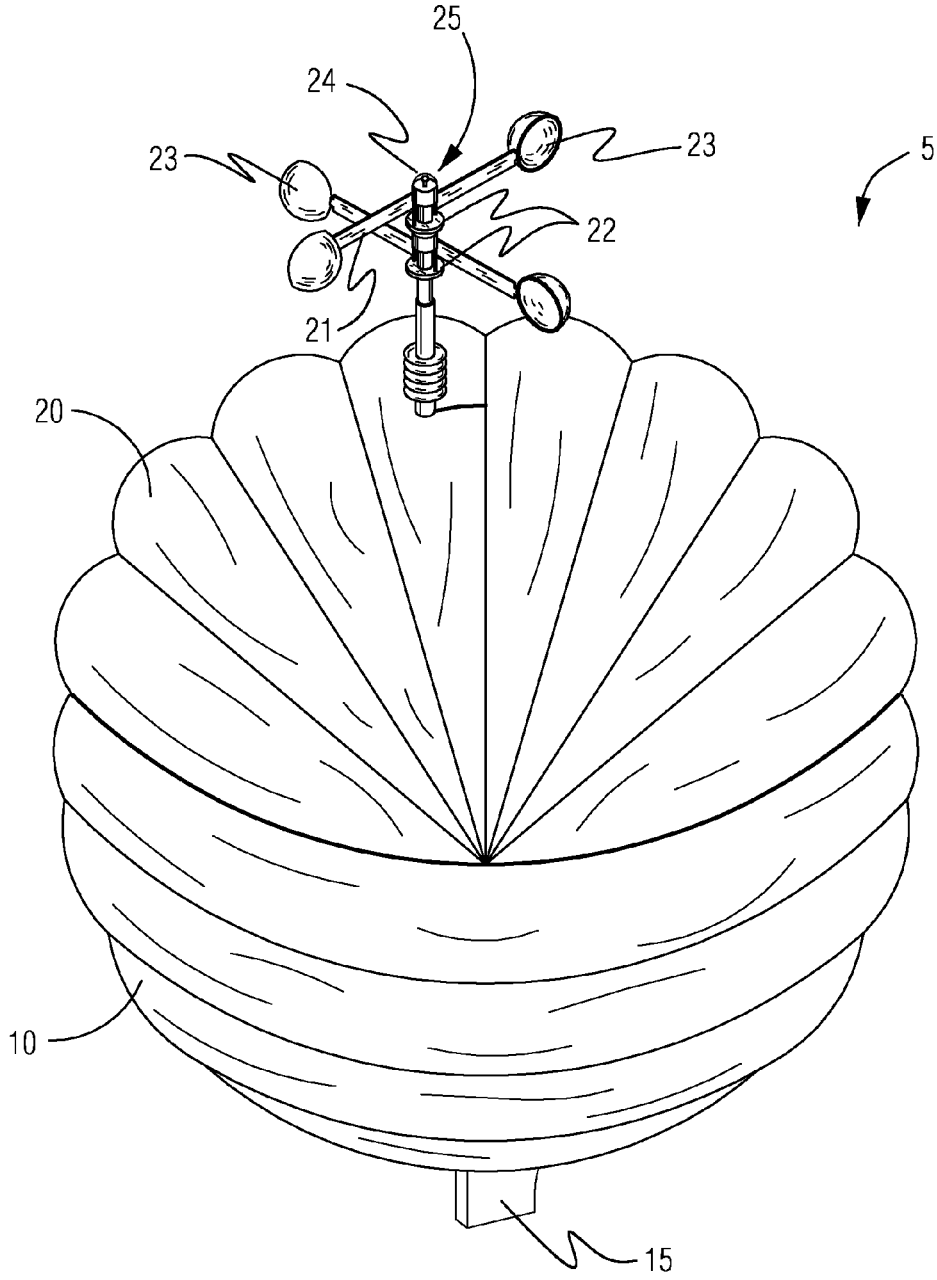
FIG. 1 is a front view of the device completely deployed.
Figure 2:
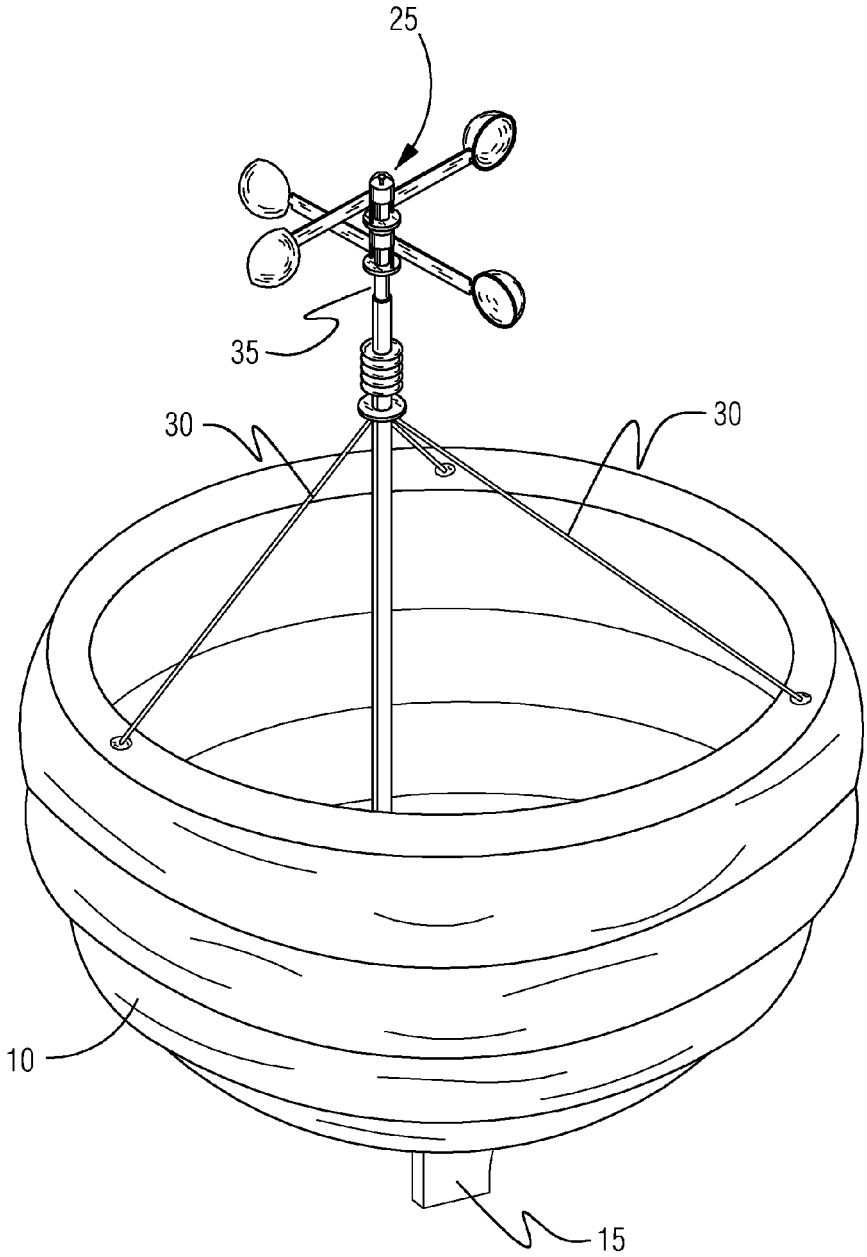
FIG. 2 is a front view of the device showing the interior contents.

The present invention is an inflatable raft 5 that acts as a life floatation and rescue mechanism during emergency situations. The raft 5 is most likely made of durable rubber or plastic and is waterproof and is comprised of two shells, a bottom shell 10 and an upper shell 20. When the device is fully deployed it will have the appearance of a sphere such as depicted in FIG. 1.

The lower half of the shell 10 is made from a rigid material that can withstand extremes in all environmental conditions. On the top of the lower half of the shell will be a means to connect a plurality of support members 30 that will help the structure maintain its form during period of inclement or extreme weather.

Figure 3:
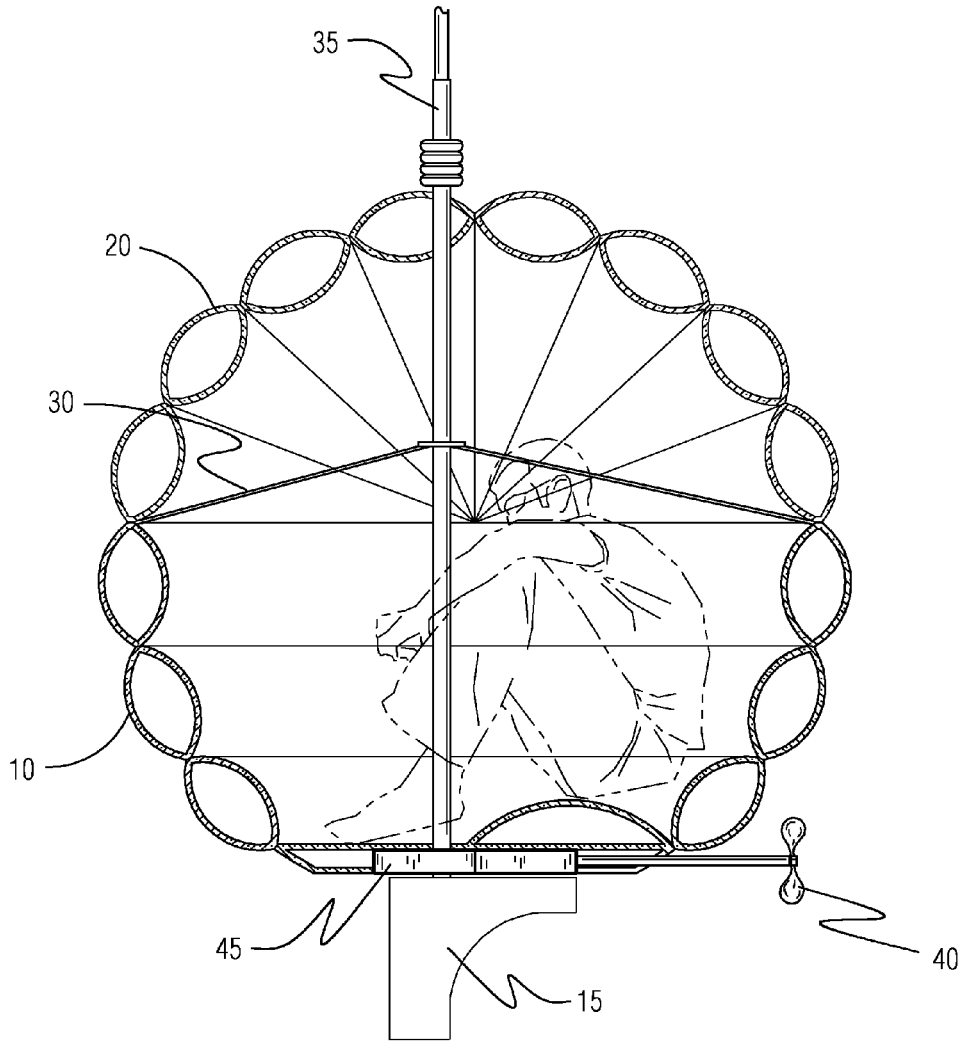
FIG. 3 is the device fully deployed with the depiction of an individual contained within the device.

The upper half of the shell 20 is also made of durable material but the material that is chosen for the upper half needs to be semi-rigid so that it can be folded over the lower half in order to form the protective sphere as depicted in FIG. 3. The specific choices of material are not important other than they need to be able to withstand extremes in environmental conditions and be waterproof.

On the lower half is a false bottom that provides an area where the person can sit and also provides a means to store the battery and electric motor 45 and propeller shaft for the propeller 40 as depicted in FIG. 3.

A means to secure the top half and the bottom half must also be provided to insure that the spherical shape remains intact during the period of inclement weather. There are a variety of means such as a hook and loop assembly or straps to connect the respective halves or other means may be used and no specific means is being claimed.

Although the device is designed to insure that the person is protected during a period of extremely violent weather, some means must be provided to insure that an adequate supply of oxygen is allowed to enter the interior of the device. This can be accomplished with a small opening of the top or some other similar means and no specific means is being claimed.

A keel 15 is placed on the bottom of the lower half to provide some stability for the structure.

Attached to the top of the false bottom is a telescopic shaft 35. The shaft 35 extends from the false bottom and extends through an opening in the upper half of the shell.

In order to provide stability and help the shape of the device a plurality of support members 30 extend from the top surface of the bottom half of the shell at one end and are affixed to the telescoping shaft 35.

At the top of the shaft 35 will be a wind harnessing mechanism 25. The wind harnessing mechanism 25 will be comprised of four wind catching devices or cups 23 designed to catch and move with the wind. Two cups 23 are connected to each other and spin around the shaft 35 attached to elongated arms 21 and produce electricity within electric generators 22 located in the shaft 35; the other two cups 23 will be attached to each other and spin in the opposite direction. Generators 22 are installed at the end of the cups 23 to generate electricity and provide power to a light 24 that is placed on the end of the telescoping shaft 35.

The light 24 may be a solid light or may be a strobe light that will alert rescuers to the location of the raft 5. The device may also emit a radio frequency signal to alert others in the area of the location of the individual.

As the wind is being harnessed, the movement of the telescoping shaft 35 will also rotate an electric motor 45 that is placed below the false bottom on the bottom half. The electric motor will provided some degree propulsion through a propeller 40 that is attached at the end of the propeller shaft for that purpose. In addition to powering the electric motor some means to store the produced energy in a battery may also be provided.

The battery will be used to store power in the even of a lack of wind after the inclement weather has passed.

Figure 4:
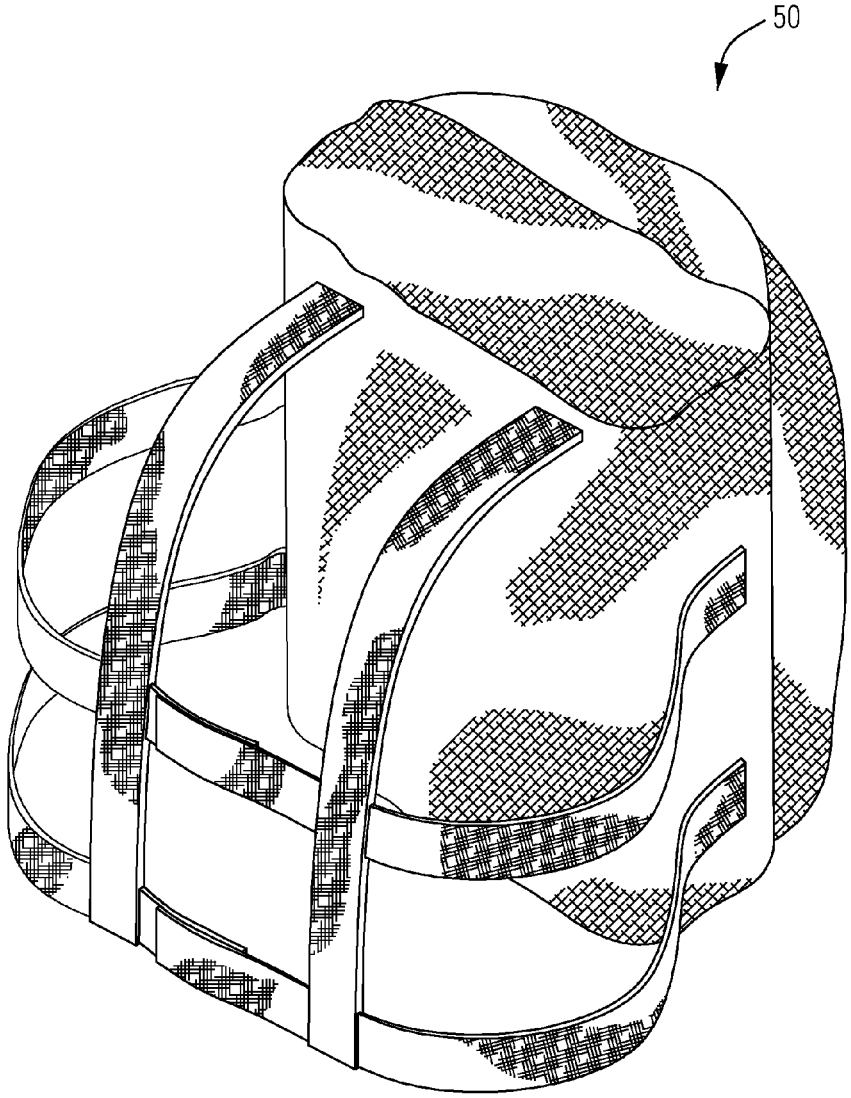
FIG. 4 is an isometric view of the storage means for this device.

The present invention can be collapsed and folded into a small size. In the storage state, the present invention is also provided with a storage means 50 such as a backpack such as depicted in FIG. 4. The device 5 is also equipped with a self-inflation mechanism that allows a user to quickly inflate the raft 5 when an emergency arises.

Because of the exposure to water the choice of material should be non-corrosive and durable; plastic is probably an excellent choice of material.

While the embodiments of the invention have been disclosed, certain modifications may be made by those skilled in the art to modify the invention without departing from the spirit of the invention.

The inventor claims:

1. A flotation device to be used during emergency situations which is comprised of:

a. a shell;

said shell has two halves;

wherein an upper half is provided;

wherein a bottom half is provided;

wherein the shell is waterproof;

b. bottom half;

wherein a false bottom is provided in the bottom half;

c. a telescoping shaft;

wherein the telescoping shaft has a first end and a second end;

said first end of the telescoping shaft is secured to the false bottom in the bottom half;

said second end of the telescoping shaft extends through an opening in the upper half when the device is deployed;

d. a wind harnessing mechanism;

wherein a wind harnessing mechanism is placed at the second end of the telescoping shaft;

said wind harnessing mechanism captures wind energy;

wherein the wind harnessing mechanism employs a plurality of cups;

said cups are attached to the shaft and freely rotate around the shaft;

said cups are secured to a plurality of generators with a pair of arms;

e. the plurality of generators;

wherein the plurality of generators are secured to the second end of the telescoping shaft;

f. a light;

wherein a light is provided on the second end of the telescoping shaft;

said light is powered by the generators;

g. a keel;

wherein the keel is attached to the bottom surface of the bottom half;

h. a plurality of support members;

wherein the support members have a first and second end;

wherein the first end is secured to the top surface of the bottom half of the shell of the device;

wherein the second end of each of the plurality of support members is secured to the telescopic shaft;

i. an electric motor and battery assembly;

wherein said electric motor and battery assembly located within the false bottom floor of the lower shell;

wherein said battery is connected to the generators through conductive means;

j. a propeller;

wherein said propeller is fixedly attached to the motor along a rotating axle;

wherein said propeller is located outside of the bottom floor of the floatation means; and wherein said propeller is powered by the motor;

k. the upper half shell is semi-rigid and waterproof, and when deployed the upper and bottom halves of the shell encapsulate a user and have the form of a sphere.

2. The device as described in claim 1 wherein the device is folded and compressed into a portable container when not in use.

3. The device as described in claim 1 wherein the light is a strobe light.

4. The device as described in claim 1 wherein a radio frequency is emitted.

* * * * *